United States Patent [19]

Jensen et al.

[11] Patent Number: 4,543,771

[45] Date of Patent: Oct. 1, 1985

[54] PHOTOGRAPHIC SLIDE MOUNTER

[75] Inventors: Gerald A. Jensen, Plymouth; Charles L. Euteneuer, St. Michael, both of Minn.

[73] Assignee: Pako Corporation, Minneapolis, Minn.

[21] Appl. No.: 338,201

[22] Filed: Jan. 11, 1982

[51] Int. Cl.[4] ..... B65B 5/04; B65B 63/00

[52] U.S. Cl. ..... 53/520; 53/266 R; 83/373; 83/607

[58] Field of Search ..... 53/266 R, 520; 226/189; 83/373, 440.2, 441, 443, 444, 450, 607, 608, 609; 493/459, 460, 461, 465

[56] References Cited

U.S. PATENT DOCUMENTS

| | | | |
|---|---|---|---|
| 1,602,600 | 10/1926 | Webb | 226/189 X |
| 2,308,086 | 1/1943 | Landrock | 83/373 |
| 2,506,610 | 5/1950 | Mueller | 83/443 |
| 2,519,552 | 8/1950 | Eller | 83/450 X |
| 2,797,088 | 6/1957 | Lorig . | |
| 3,341,960 | 9/1967 | Florjancic et al. | 40/152 |
| 3,470,642 | 10/1969 | Mundt et al. | 40/152 |
| 3,478,456 | 4/1968 | Mundt et al. | 40/152 |
| 3,521,544 | 7/1970 | Good | 226/189 X |
| 3,524,299 | 8/1970 | Mundt et al. | 53/23 |
| 3,562,074 | 2/1971 | Mundt et al. | 156/580 |
| 3,570,342 | 3/1971 | Mundt | 83/93 |
| 3,614,854 | 10/1971 | Mundt et al. | 53/381 R |
| 3,788,031 | 1/1974 | Florjancic | 53/123 |
| 3,807,121 | 4/1974 | Mundt et al. | 53/23 |
| 3,896,603 | 7/1975 | Tout | 53/520 |
| 3,943,029 | 3/1976 | Mundt et al. | 156/443 |
| 3,977,280 | 8/1976 | Mundt et al. | 83/443 |
| 4,004,340 | 1/1977 | Urban | 29/417 |
| 4,102,029 | 7/1978 | Thompson | 29/417 |
| 4,135,343 | 1/1979 | Urban et al. | 53/435 |
| 4,139,980 | 2/1979 | Larson | 53/520 |
| 4,330,978 | 5/1982 | Willenbring | 53/520 |
| 4,391,082 | 7/1983 | Diesch | 53/250 X |

FOREIGN PATENT DOCUMENTS

| | | | |
|---|---|---|---|
| 507172 | 8/1930 | Fed. Rep. of Germany | 83/443 |
| 354151 | 8/1931 | United Kingdom | 83/443 |

OTHER PUBLICATIONS

"Operating Instructions for Semi-Automatic Mounters-Types 6001 & 7004", Aug. 1977.

*Primary Examiner*—John Sipos

*Attorney, Agent, or Firm*—Kinney & Lange

[57] ABSTRACT

A photographic slide mounter cuts photographic film transparencies from a photographic film web and inserts the transparencies into slide mounts. A slide mount is advanced along a slide track to a position adjacent a knife where the slide mount is flexed to provide an insertion opening. The film web is advanced along a film track until a leading end of the web is partially inserted into the insertion opening. A first plurality of rollers are positioned over the film track and a second plurality of rollers are positioned under the film track to prevent transverse curl of the film web as it is advanced toward the insertion opening. A pair of curved shoes is mounted over the film track proximate the knife to prevent longitudinal curl of the film web as it is advanced through the knife and into the insertion opening. The knife is provided with tapered portions to align the web as it passes the knife. After the transparency has been severed from the film web by the knife, the partially inserted transparency is engaged and inserted fully into the slide mount as the slide mount and transparency are advanced away from the film track. The slide mount insertion opening is maintained in a flexed open position as the transparency is engaged and fully inserted by a slide mount spreading means having a flared portion. Once the film transparency has been fully inserted into the slide mount, the slide mount insertion opening is allowed to close.

7 Claims, 9 Drawing Figures

PHOTOGRAPHIC SLIDE MOUNTER

CROSS-REFERENCE TO CO-PENDING APPLICATIONS

Reference is made to co-pending U.S. patent application Ser. No. 144,284, filed May 9, 1980, co-pending U.S. patent application Ser. No. 152,023, filed May 30, 1980 (issued as U.S. Pat. No. 4,331,260 on May 25, 1982), co-pending U.S. patent application Ser. No. 202,600, filed Oct. 31, 1980 (issued as U.S. Pat. No. 4,355,748 on Oct. 26, 1982, and co-pending U.S. patent application Ser. No. 204,555, filed Nov. 6, 1980 (issued as U.S. Pat. No. 4,391,082 on July 5, 1983), all of which are assigned to the same assignee as the present invention.

BACKGROUND OF THE INVENTION

1. Field of the Invention

The present invention relates to photographic slide mounting apparatus.

2. Description of the Prior Art

Photographic slides are produced by mounting a photographic film transparency into a slide mount frame so that the image of the photographic transparency is aligned with the aperture of the slide mount frame. A variety of different types of mounting frames and mounting apparatus have been developed.

One particularly advantageous type of photographic slide mount is the Pakon Slide Mount, which is a one-piece plastic slide mount sold by Pako Corporation, the assignee of the present application. The film transparency is mounted by flexing open a film insertion slot in the slide mount by means of mounting equipment. The transparency is inserted into the mount and the mount is closed. The spring-like properties of the plastic slide mount material provide the transparency with a safe and tight fit in the slide mount without the need for welding or sealing. United States Patents showing slide mounts and slide mounting apparatus of this general type include the following patents:

| Inventor(s) | U.S. Pat. No. |
|---|---|
| Florjancic et al. | 3,341,960 |
| Mundt et al. | 3,470,642 |
| Mundt et al. | 3,478,456 |
| Mundt et al. | 3,524,299 |
| Mundt et al. | 3,562,074 |
| Mundt | 3,570,342 |
| Mundt et al. | 3,614,854 |
| Florjancic | 3,788,031 |
| Mundt et al. | 3,807,121 |
| Mundt et al. | 3,943,029 |
| Mundt et al. | 3,977,280 |
| Urban | 4,004,340 |
| Urban et al. | 4,135,343 |
| Thompson | 4,102,029 |

Apparatus has been developed for both manual and automatic mounting of transparencies in Pakon Slide Mounts. The manual mounting procedure utilizes a hand-held mounting device into which the slide mount is inserted. By grasping the mount and the mounter together at one side, the film insertion opening is widened to permit insertion of a transparency into the slide mount. The transparency has previously been cut from a strip or web of photographic film containing many individual transparencies and is inserted manually into the slide mount.

While the hand mounting apparatus procedure is adequate for mounting small quantities of transparencies in slide mounts, it clearly is not suitable for large-scale production of mounted transparencies as is required in professional photofinishing laboratories. The Pakon 509 Slide Mounter sold by Pako Corporation is an automatic, motor-driven apparatus which mounts photographic film transparencies in Pakon Slide Mounts at rates of up to 160 slides per minute.

In some cases, however, the quantity of transparencies to be mounted by a photofinishing laboratory is not enough to justify the use of automatic slide mounting apparatus such as the Pakon Slide Mounter, yet is greater than that which can be efficiently performed manually. To meet this need, semi-automatic slide mounters have been developed, such as the Type 6001 and 7004 slide mounters developed by Geimuplast Peter and Mundt KG. These semi-automatic slide mounters operate in a manner generally similar to the automatic Pakon 509 Slide Mounter but are driven by an operating handle which is moved by the operator, rather than being motor driven.

The Type 6001 and 7004 semi-automatic slide mounters are operated by moving the operating lever through an operating cycle. During this cycle, the following five functions are performed. First, an insertion slot in a slide mount is widened to receive the transparency. Second, the film web is advanced and inserted into the mount. Third, the transparency is severed from the remainder of the film web. Fourth, the transparency is inserted completely into the slide mount. Fifth, the mounter ejects the mounted slide. These five functions form a complete mounting cycle for each transparency.

Each transparency of a film web contains a photographic image representing a singular instant in time, which in many cases cannot be recreated if the transparency is lost or damaged. Since photographic film transparencies are such a unique commodity, it is very important that the film web and transparencies progress smoothly through the slide mounter to prevent damage to the photographic images contained thereon. If the film web becomes misaligned in the film track, it can become jammed in the machine or miscut by the knife and destroyed. This problem is amplified by the fact that photographic film is coated on one side with an emulsion and this emulsion causes the film to curl transverse to its direction of advancement through the slide mounter. In addition, photographic film strips are usually spliced together to form a "film web" and wound on a reel for developing so that when unwound for mounting in slide mounts, the film web has a longitudinal curl due to being wrapped around the reel. These two types of curl, transverse and longitudinal, can cause considerable problems in feeding the film web through the film track into the slide mount insertion opening in a uniform manner.

In addition to the problems of film curl, it is important that the film track and any areas through which the film web passes be clear of possible obstructions on which the film web could catch and be damaged. Once a transparency has been partially inserted into the slide mount and severed from the film web, it must still be fully inserted into the slide mount without damage to the transparency. The insertion opening of a slide mount must be maintained in a flexed open position as the transparency is fully inserted into the slide mount to prevent scratching or damage to the photographic image.

SUMMARY OF THE INVENTION

The present invention is an improved slide mounter apparatus for mounting photographic film transparencies into slide mounts. The apparatus of the present invention includes a film track having first and second ends for guiding a photographic film web from its first end to an insertion station adjacent its second end. At the insertion station, a slide mount is spread apart by a spreading means to form an insertion opening for reception of the film transparency. The transparency, while still an integral portion of the film web, is advanced along the film track past a knife means and into the insertion opening of the slide mount. A first plurality of elongated anti-curl rollers rotatably positioned over the film track proximate its first end and a second plurality of elongated anti-curl rollers rotatably positioned under the film track proximate its second end prevent transverse curl of the film web. Mounted over the film track proximate its second end is a pair of curved shoes positioned to prevent longitudinal curl of the film web as the film web travels through the knife means and into the slide mount insertion opening. Tapered portions on the knife means are provided to guide and align the film web as it travels through the knife means. After the transparency has been partially inserted into the slide mount, it is severed from the film web by the knife means, and the slide mount and the partially inserted transparency are moved away from the insertion station. Simultaneously, an insertion lever engages the transparency and inserts it fully into the slide mount. A flared portion on the spreading means maintains the slide mount insertion opening in a spread position as the transparency is inserted fully into the slide mount.

DETAILED DESCRIPTION OF THE PREFERRED EMBODIMENT

Figure 1:
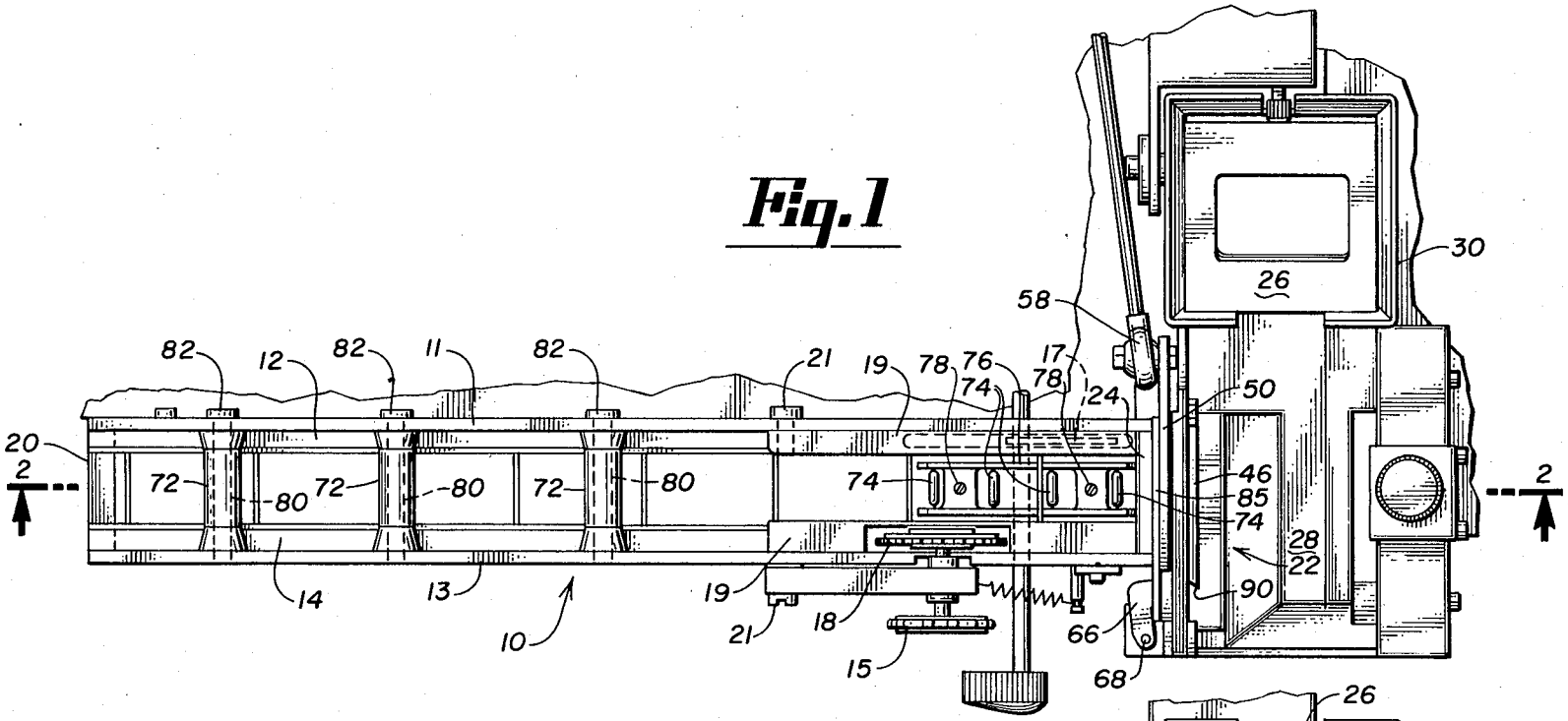
FIG. 1 is a top plan view of the film track in a photographic slide mounter of the present invention.
Figure 2:
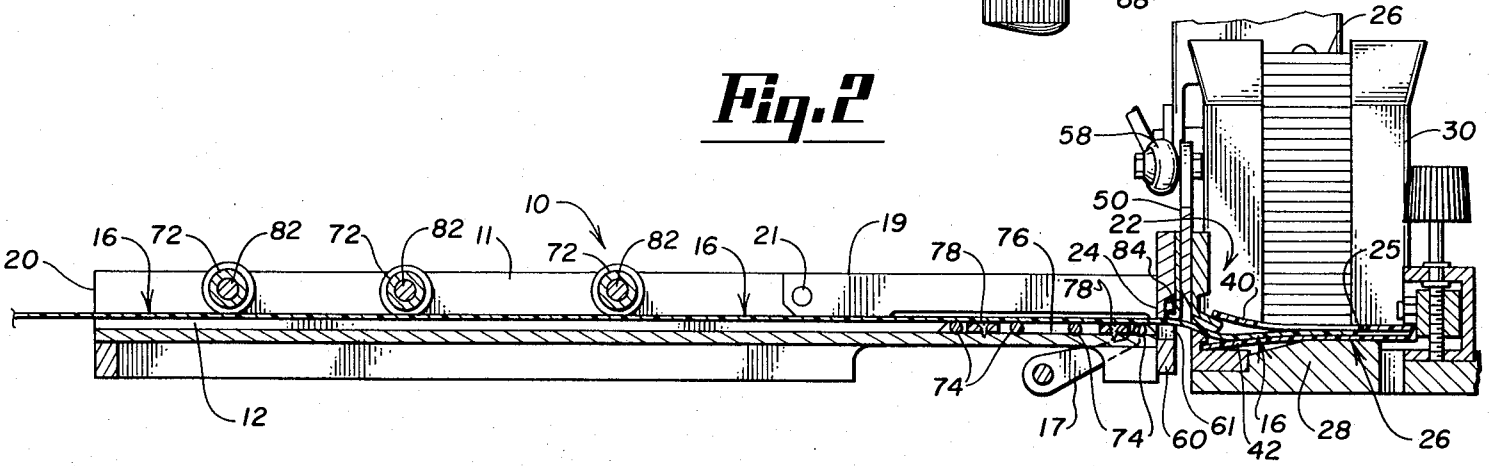
FIG. 2 is a sectional view taken along line 2—2 of FIG. 1 and showing the path of a film web along the film track.

FIGS. 1 and 2 shows a film guide track 10 of a semi-automatic slide mounter having the film damage prevention improvements of the present invention. A semi-automatic slide mounter of the type referred to is described in detail in co-pending U.S. patent application Ser. No. 144,284, filed May 9, 1980, co-pending U.S. patent application Ser. No. 152,023, filed May 30, 1980, (now U.S. Pat. No. 4,331,260) and co-pending U.S. patent application Ser. No. 202,600, filed Oct. 31, 1980 (now U.S. Pat. No. 4,335,748).

In the improved slide mounter of the present invention, film track 10 has side walls 11 and 13 and a pair of film rails 12 and 14 upon which the edges of a photographic film web 16 lie as film web 16 is advanced through the film track 10. Film web 16 (shown in FIG. 2) is advanced from a first end 20 of the film track 10 to an insertion station 22 at a second end 24 of the film track 10. Film web 16 may be advanced along the film track 10 manually by turning knob 15 attached to sprocket wheel 18 so that the sprockets of sprocket wheel 18 engage the sprocket holes along the edge of the film web 16, or film web 16 may be advanced mechanically by an advance pawl 17 which is driven by advance means described in detail in co-pending U.S. patent application Ser. No. 202,600, filed Oct. 31, 1980 (now U.S. Pat. No. 4,355,748).

The edges of film web 16 are urged downwardly onto rails 12 and 14 into engagement with the advance pawl 17 by guide flaps 19, which are pivotally mounted in side walls 11 and 13 of film track 10 by pivot pins 21. If film web 16 meets with resistance at insertion station 22, breakaway means (not shown but described in detail in co-pending U.S. patent application Ser. No. 202,600, filed Oct. 30, 1980 (and since issued as U.S. Pat. No. 4,355,748) are provided to allow film flaps 19 to pivot upward from the film track 10 about the axis defined by pivot pins 21 to prevent damage to the film web 16.

Figure 3:
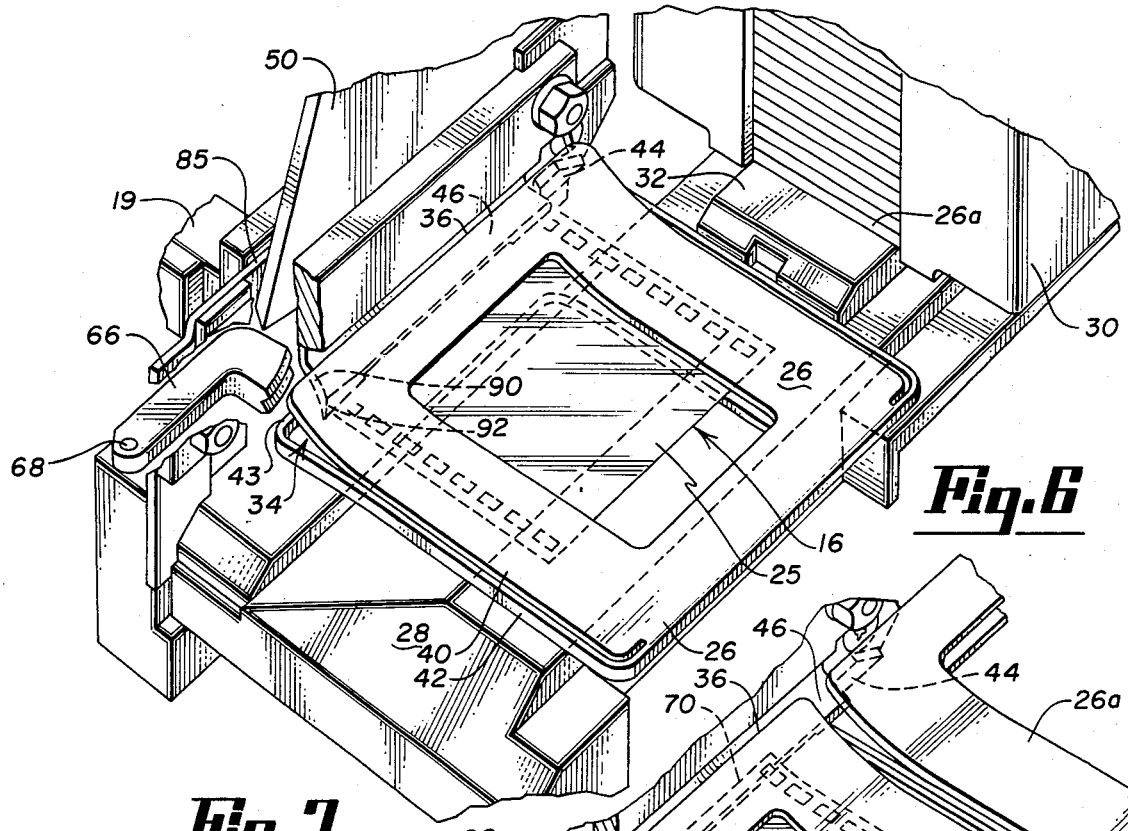
FIG. 3 is a perspective view of the insertion operation of the slide mounter prior to severing a transparency from the film web.

At insertion station 22, the leading end 15 of the film web 16 is inserted into a slide mount 26. The positioning of slide mount 26 for acceptance of the leading end 25 of film web 16 is shown in FIGS. 2 and 3. Slide mount 26 is advanced along slide track 28 from a stack of empty slide mounts 26 maintained in slide magazine 30 by slide ejector 32. Slide track 28 is positioned perpendicularly to film track 10 at its second end 20. Insertion station 22 is defined by the intersection of slide track 28 and film track 10. As slide mount 26 is advanced along slide track 28 to insertion station 22 as shown in FIG. 3, an insertion opening 34 along edge 36 of slide mount 26 is opened up to permit insertion of the leading end 25 of film web 16 into slide mount 26. Empty slide mounts 26 are loaded into slide magazine 30 so that edge 36 (which faces film track 10) contains the insertion opening 34 of each slide mount 26. The slide mounts 26 are preferably of the type which are a plastic unitary structure with a lid or upper portion 40 and a base or lower portion 42 welded together, ready for use in a slide projector. The Pakon slide mount is an example of this type of slide mount.

As a lowermost slide mount 26 is ejected from slide magazine 30 and advanced along slide track 28 by slide ejector 32, lip 43 of the base 42 of slide mount 26 slides under a wedged ramp 44 and is bent downward. This creates insertion opening 34 between the base 42 and the lid 40 allowing an insertion flange 46 to enter the insertion opening 34 of slide mount 26. As slide mount 26 is advanced along slide track 28 to the insertion station 22, ramp 44 and flange 46 raise lid 40 while holding lip 43 of base 42 downward thereby opening the insertion opening 34 sufficiently to permit leading end 25 of film web 16 to be inserted into slide mount 26 without being scratched.

Insertion station 22 also includes knife means for severing a film transparency 48 from the film web 16.

Figure 4:
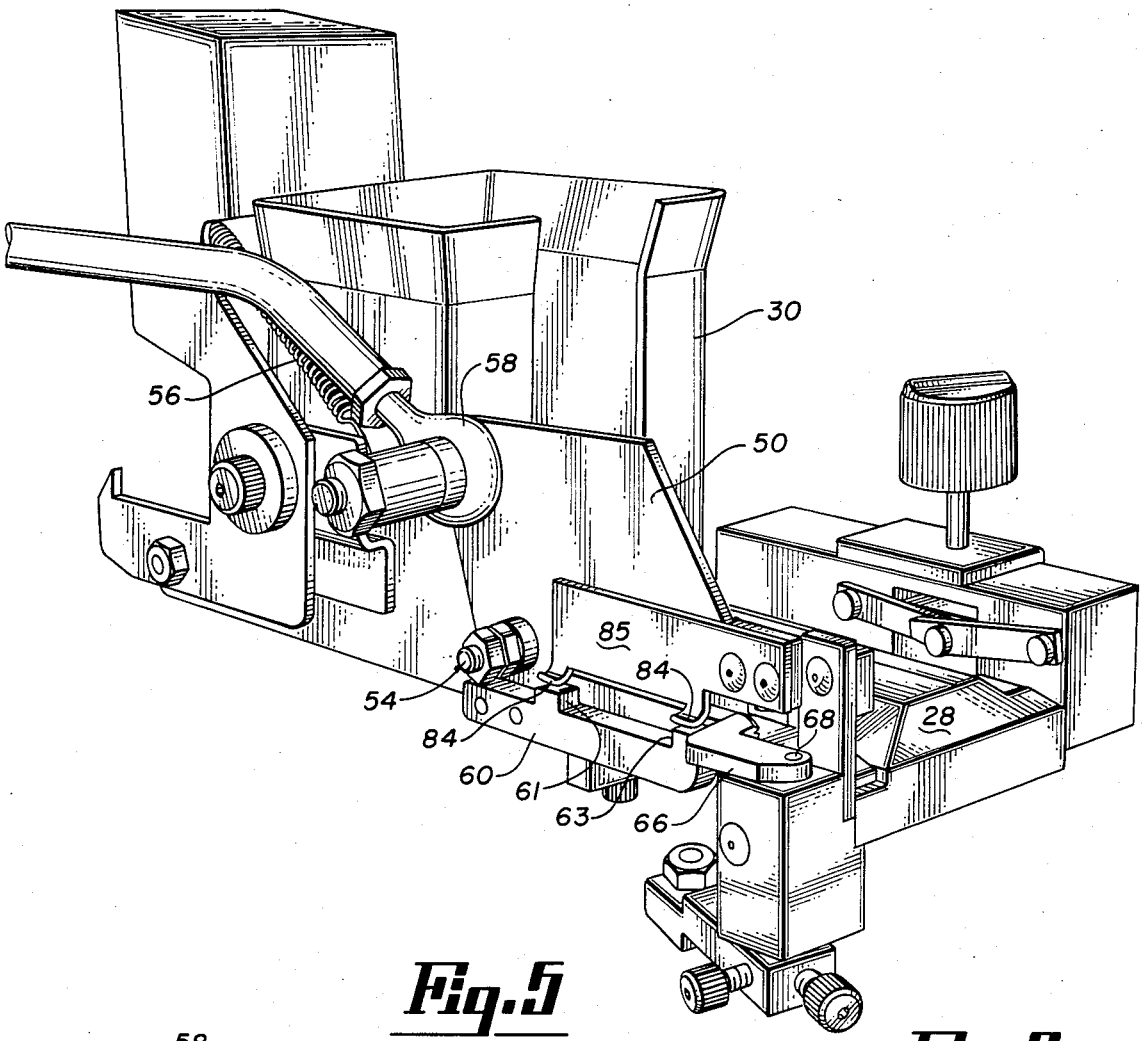
FIG. 4 is a pictorial view in perspective of a slide mounter insertion station with some parts removed for clarity.
Figure 5:
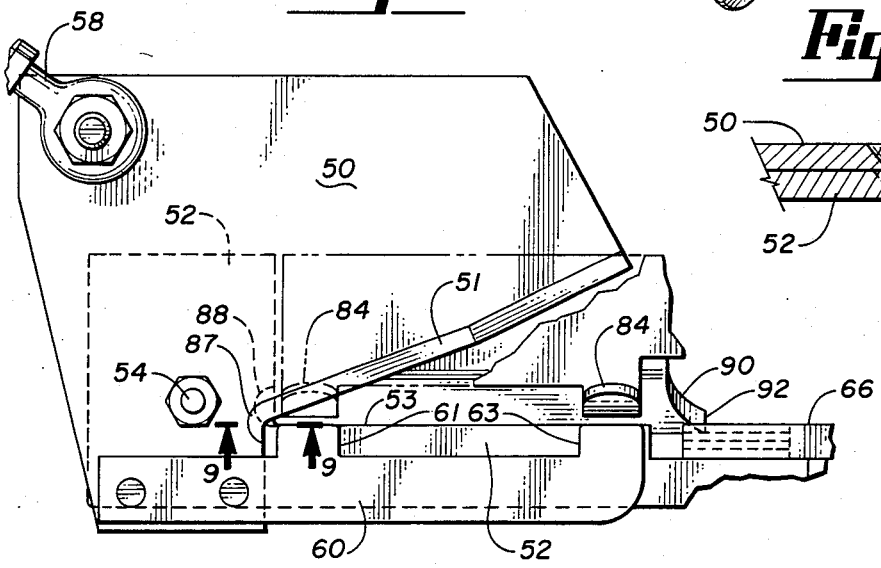
FIG. 5 is a front elevation of the knife means for cutting film transparencies in the slide mounter with some parts removed and broken away.

As illustrated in FIGS. 4 and 5, the knife means preferably is a scissors-type knife which includes a pivoted upper blade 50 and a stationary lower blade 52 which cooperate to sever the transparency 48 from film web 16. Knife blades 50 and 52 are positioned at the second end 24 of film track 10, where film track 10 meets slide track 28 to form insertion station 22. Upper blade 50 is pivotally mounted to lower blade 52 at pivot point 54, and is held in a normal upstanding position shown in FIGS. 4 and 5 by bias spring 56. Blade 50 is driven through knife actuating link 58 by the drive means (not shown but described in detail in co-pending U.S. patent application Ser. No. 144,284, filed May 9, 1980) of the slide mounter. Each blade has a front side facing the second end 24 of the film track 10, and on the front side of each blade is a cutting edge extending from adjacent the pivot point end of the blade to the other end of the blade: cutting edge 51 on upper blade 50 and cutting edge 53 on lower blade 52.

Secured at the lower end of blade 50 is a support block 60 having legs 61 and 63 for supporting the edges of the film web 16 as it passes from the second end 24 of the film track 10 into the insertion station 22 (and under and over blades 50 and 52, respectively). When the upper blade 50 is in an open upstanding position (as shown in FIGS. 2, 4 and 5), the legs 61 and 63 of support block 60 support the edges of film web 16, and when blade 50 is actuated to pivot downwardly about pivot point 54, the support block 60 swings downwardly with blade 50 about the pivot point 54 as blades 50 and 52 cooperate to sever the transparency 48 from film web 16.

After slide mount 26 is in position to receive the leading end 25 of film web 16, slide ejector 32 is retracted and film web 16 is advanced through the insertion opening 34 into slide mount 26. Once film web 16 has been advanced so that the desired location for severing transparency 48 from film web 16 is aligned with the knife blades 50 and 52, advancement of the film web 16 is stopped. Upper blade 50 is then driven downwardly to cooperate with fixed lower blade 52 to sever transparency 48 from the remainder of the film web 16.

Figure 6:
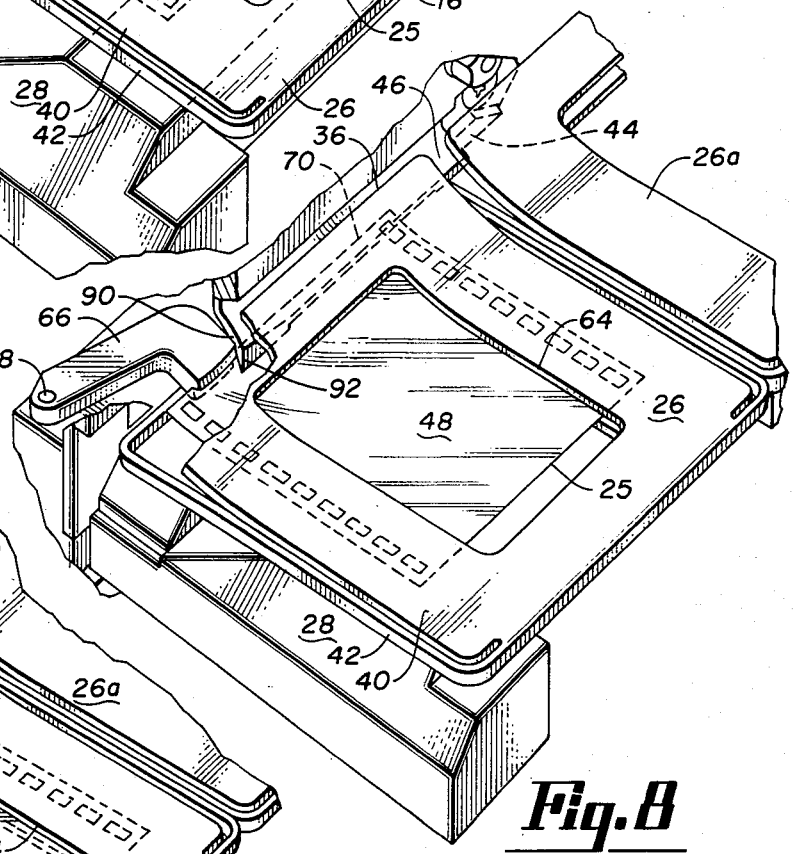
FIGS. 6–7 are perspective views similar to FIG. 3 of the insertion operation of the slide mounter showing the operation of an insertion lever inserting fully the transparency into the slide mount.
Figure 7:
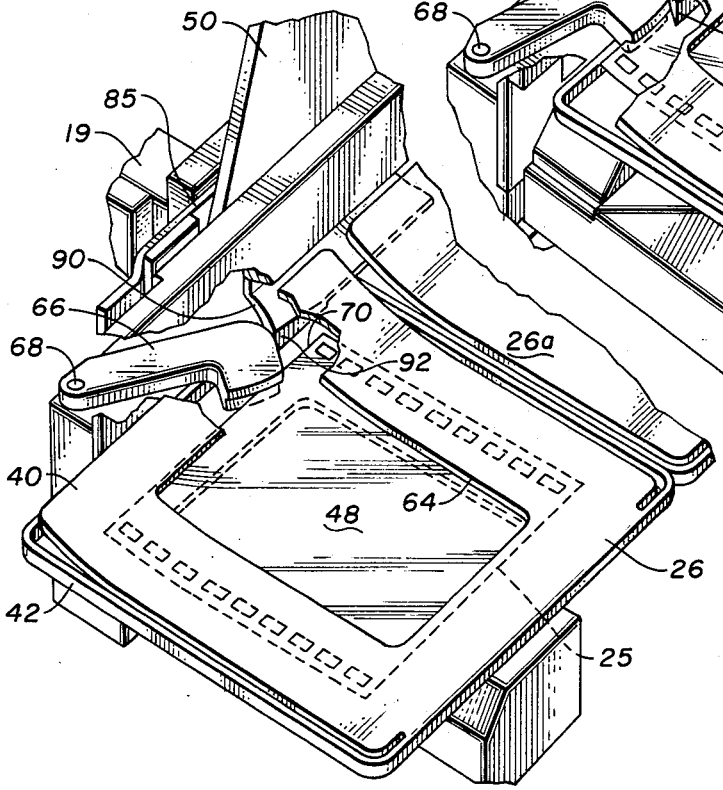

FIGS. 6 and 7 illustrate the further operations which are performed after transparency 48 is severed from web 16. Since the severing of transparency 48 from film web 16 occurs outside of slide mount 26, transparency 48 is not yet fully inserted into slide mount 26, as shown in FIG. 6. The insertion of transparency 48 the remaining distance into slide mount 26 (so that the image area of transparency 48 is properly aligned with aperture 64 of slide mount 26) is achieved during the portion of the slide mounter operating cycle illustrated in FIGS. 5 and 6. In this portion of the cycle, slide ejector 32 begins to push a next slide mount **26*a* out from under the bottom of slide magazine 30 and onto slide track 28. The advancement of slide mount 26*a* pushes previous slide mount 26 along slide track 28 away from the insertion station 22. As slide mount 26 is advanced away from the second end 24 of film track 10 and the insertion station 22, an insertion lever 66 is pivoted at pivot point 68 to engage trailing edge 70 of transparency 48 and push transparency 48 the remaining distance into slide mount 26**.

FIG. 3 is broken away to illustrate the normal position of insertion lever 66 and FIGS. 6 and 7 are broken away to illustrate the operation of insertion lever 66 as it drives transparency 48 the remaining distance into slide mount 26. As slide mount 26 is pushed along slide track 28 by new slide mount **26*a*, the lid 40 and base 42 of slide mount 26 are maintained spread apart at edge 36 of the slide mount 26 by insertion flange 46. Once the transparency 48 has been fully inserted into slide mount 26, lid 40 and base 42 are allowed to snap back to a normal closed position so that the transparency 48 is securely mounted within the slide mount 26** ready for use in a slide projector.

Photographic film is coated on one side with emulsion layers which cause the film to tend to curl. A film web 16 ready for mounting in slide mounts 26 is usually advanced through the slide mounter with the emulsion side facing up which causes the film web 16 to curl transverse to its direction of advancement through the film track 10. Thus, the longitudinal edges of the film web 16 curl upwardly while the center bows downwardly in the film track 10. Because of this transverse or tunnel curl, the width of the film web 16 relative to the film track 10 is narrowed and the film web 16 can advance through the film track 10 at an angle. When this occurs, the sprocket holes of film web 16 are not properly aligned with advance pawl 17 and it becomes difficult to advance the film web 16 uniformly and correctly into slide mount 26 at insertion station 22. The film web 16 misaligned in this nature, is subject to considerable damage both by jamming in the slide mounter and by miscutting by the knife means.

To counteract this transverse curl, a first plurality of elongated anti-curl rollers 72 is rotatably positioned over the film track 10 proximate its first end 20. Each roller 72 is formed in an hourglass shape as shown in FIG. 2 so that the diameter of the roller is larger at its end than at its midportion. The ends of each roller 72 taper outwardly so that the roller 72 engages only the upwardly curling edges of the film web 16 and urges them downwardly onto the rails 12 and 14 of film track 10. In this way, anti-curl rollers 72 flatten film web 16 to its normal width and maintain it in the film track 10 properly without contacting, and possibly scratching, the central area of the emulsion side of film web 16. Each elongated roller 72 has a central throughbore 80 for acceptance of a pivot pin 82. The side walls 11 and 13 of film track 10 are also apertured for acceptance of pivot pins 82 so that the pins 82 provide a spaced apart means for rotatably mounting rollers 72 over film track 10.

Transverse curl of the film web 16 is also a problem near the second end 24 of the film track 10. Because the edges of the film web 16 carry the sprocket holes employed in advancing the film web 16 through the film track 10, when the edges curl upwardly the sprocket holes curl out of engagement with the advance pawl 17 and the film web 16 is not advanced in a uniform manner. Guide flaps 19 maintain and urge the edges of film web 16 downwardly over the advance pawl 17, but do not completely solve the problem. A second plurality of elongated anti-curl rollers 74 is rotatably positioned under the film track 10 proximate its second end 24 so that rollers 74 engage the bottom of film web 16 and urge upwardly the bowed center of the film web 16. This in turn pushes the edges of the film web 16 outwardly and into position for correct engagement with the advance pawl 17. Guide flaps 19 and rollers 74 cooperate to counteract the transverse curl of the film web 16 adjacent advance pawl 17 so the film web 16 can be advanced uniformly through the slide mounter.

Rollers 74 extend less than the full width of the film track and are rotatably mounted on a roller support base 76 secured by fasteners (such as screws) 78 to the slide mounter. The top of rollers 74 is approximately the same height as rails 12 and 14 so that the film web 16 is flattened as it passes over the rollers 74 and toward insertion station 22. Preferably, the rollers 74 are teflon impregnated aluminum rollers so that they roll smoothly across the central area of the bottom of film web 16 and do not scratch or damage film web 16. Additionally, each roller 74 has a concentric pivot pin at each end of the roller 74 and the roller support base 76 has spaced apart apertures for acceptance of the pivot pins of rollers 74. The base 76 is constructed of a flexible material so that the base 76 is merely flexed to allow insertion or removal of the pinned ends of rollers 74 into the apertures of the base 76.

Of course, the positioning and operation of rollers 72 and 74 works just as well when the film web 16 is advanced through the slide mounter with the emulsion side facing down. The rollers 72 and 74 still act to flatten out the film web 16 as it is advanced through film track 10 for proper alignment and engagement with the advance pawl 17.

For photoprocessing purposes, individual photographic film strips are usually spliced together into a long film web and wound on a reel for handling. When the film web is unwound from the reel and advanced through the slide mounter, it often has a longitudinal curl due to being wrapped around the reel. This curl also presents problems in mounting photographic transparencies into slide mounts. In the slide mounter of the present invention a pair of curved shoes 84 are mounted over the film track 10 proximate its second end 24 to counteract this longitudinal curl of the film web 16 as the film web 16 travels through the knife means and into the slide mount insertion opening 34.

Figure 8:
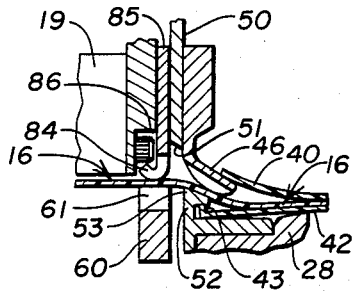
FIG. 8 is a sectional side view of a slide mounter insertion station showing the path of a film web as it is inserted into a slide mount at the insertion station.

The curved shoes 84 are secured to a knife shield 85 which is fixedly mounted over the film web 16 adjacent the knife means. The shoes 84 are positioned at the lower edge of the knife shield 84 and are shaped to curve away from the knife means toward the film track 10 and then curve upwardly from the film track 10 to provide a curved surface over the longitudinal edges of the film web 16 as it is advanced into insertion station 22. As best shown in FIG. 8, the shoes 84 fit into recesses 86 at the ends of the film flaps 19 to provide a continuous, unbroken path for the film web 16 to follow. The shoes 84 urge the film web 16 downwardly and through the knife means thus preventing the film web 16 from curling upwardly and jamming in the slide mounter. The shoes 84 are shown in perspective in FIG. 4, and the operation of the shoes 84 on the film web 16 is shown in FIGS. 2 and 8. In the preferred embodiment illustrated, shoes 84 are an integral part of knife shield 85, which is fixedly mounted with respect to and above the stationary lower lower blade 52 of the knife means, as seen in FIGS. 1, 4, 5 and 8.

It is important that the film track 10 and any areas which the film web 16 passes as it advances through the slide mounter be clear of possible obstructions on which the film web 16 could catch and be damaged. In passing through the knife means, the film web 16 passes over the fixed lower blade 52 and under pivoted upper blade 50. FIG. 5 shows the relationship of the blades 50 and 52 as the film web 16 enters the knife means. The legs 61 and 63 of support block 60 are spaced below and generally parallel to shoes 84 when blade 50 is in its raised position. Legs 61 and 63 cooperate with the shoes 84 to support and guide the edges of film web 16 as it enters the insertion station. Blade 52 is fixed on the slide mounter and also supports the film web 16 as it passes through the knife means, as shown in FIG. 8.

Figure 9:
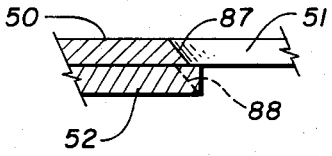
FIG. 9 is a sectional view taken along line 9—9 of FIG. 5.

To prevent the film web 16 from jamming in the knife means, tapered portions 87 and 88 are provided at the pivot point end of the cutting edges 51 and 53 of blades 50 and 52, respectively. Tapered portions 87 and 88 are aligned with one of the shoes 84 and leg 61 for maintaining the film web 16 in alignment for advancement, insertion, and severing, as shown in FIG. 5. Preferably the tapered portions are arc-shaped and formed in a 45° angle relative to the front sides of the blades 50 and 52 (as shown in FIG. 9) so that if the leading edge 25 of the film web 16 contacts one of the blades 50 and 52 adjacent the tapered portions 87 and 88, the film web 16 will be gently urged back into the insertion station area and will not catch and be damaged on the knife means. Preferably, the cutting edge 51 of upper blade 50 is tapered so that the tapered portion 87 of upper blade 50 is an arced extension of the taper of cutting edge 51 at the pivot point end of upper blade 50.

After the transparency 48 has been partially inserted into slide mount 26, the knife means is actuated (i.e., upper blade 50 is pivoted downward about pivot point 54) to sever the transparency 48 from the remainder of the film web 16. At this point, the transparency 48 has not been completely inserted into the slide mount, and still must be pushed fully into the slide mount 26 by insertion lever 66 as the slide mount 26 is advanced away from the insertion station 22 down slide track 28. During the final insertion of the transparency 48 into slide mount 26, the lid 40 and base 42 of the slide mount 26 are maintained spread apart by insertion flange 46.

In the slid mounter of the present invention (as best shown in FIGS. 6 and 7) to prevent premature closing of insertion opening 34 as slide mount 26 is advanced along slide track 28, insertion flange 46 has a flared portion 90 at one end proximate insertion lever 66. Insertion lever 66 is pivotally mounted on the slide mounter at pivot point 68 and follows an arc-shaped path in operation. Flared portion 90 is formed in an arc and is spaced closely apart from the arc-shaped path of the insertion lever 66 as it engages the transparency 48, thus maintaining the insertion opening 34 in a spread open position for as long as possible as the slide mount 26 advances down slide track 28. Insertion flange 46 and flared portion 90 keep the lid 40 and base 42 of the slide mount 26 spread away from the transparency 48 and insertion lever 66 so that the actuation of the insertion lever 66 is not interefered with nor is the transparency 48 scratched by premature closure of the slide mount 26. Preferably, flared portion 90 of flange 46 has an upward taper 92 adjacent insertion lever 66 to further enlarge the insertion opening 34 for operation of insertion lever 66. Taper 92 additionally prevents damage to the transparency 48 while being inserted into slide mount 26 by preventing possible binding of lip 40 and base 42 on insertion lever 66 as it operates.

Although the present invention has been described with reference to preferred embodiments, workers skilled in the art will recognize that changes may be made in form and detail without departing from the spirit and scope of the invention.

What is claimed is:

1. An apparatus for mounting a photographic film transparency in a slide mount, the apparatus comprising:

a substantially horizontal horizontal film track for supporting a photographic film web only along its longitudinal edges and guiding the film web to an insertion station, the film track having a first end and having a second end adjacent the insertion station;

slide mount spreading means for spreading apart portions of the slide mount to form an insertion opening in the slide mount for insertion of the transparency when the slide mount is positioned at the insertion station;

film advance means for feeding the transparency, while still an integral portion of the film web, along the film track and into the insertion opening of the slide mount;

knife means adjacent the insertion station for severing the transparency from the film web at a position outside the slide mount, the knife means having a pivoted upper blade and a stationary lower blade, one end of the pivoted upper blade being pivotally attached to one end of the stationary lower blade at a pivot point to form a scissors type knife, the blades cooperating the sever the transparency from the film web;

a first plurality of elongated anti-curl rollers rotatably positioned over the film track proximate the first end thereof to prevent transverse curl of the film web;

a second plurality of elongated anti-curl rollers rotatably positioned under the film track proximate the second end thereof to prevent transverse curl of the film web;

a pair of curved shoes mounted over the film track proximate the second end thereof, the shoes being positioned only to contact the film web along its longitudinal edges to prevent longitudinal curl of the film web as the film web enters the insertion station; and a pair of support legs adjacent the second end of the film track and under the film track and the curved shoes to cooperate with the curved shoes to support and guide the film web into the insertion station, the support legs being secured to the pivoted upper blade so that when the upper blade is in an open upstanding position, the film web is engaged and supported only at its longitudinal edges on the support legs and when the upper blade is in a closed downward severing position, the support legs are pivoted downwardly away from the film web as the film web is severed by the knife means, and each support leg being positioned under the film track and under one of the shoes to cooperate with the shoe to support and guide the film web into the insertion station.

2. An apparatus for severing a segment of photographic film from a photographic film web, the apparatus comprising:

a film track for guiding the film web along a path to a severing station;

film advance means for advancing the film web along the film track; and knife means at the severing station, the knife means having a pivoted upper blade and a stationary lower blade, one end of the pivoted upper blade being pivotally attached to one end of the stationary lower blade at a pivot point to form a scissors type knife, the blades cooperating to sever the segment from the film web, each blade of the knife means having a cutting edge extending from adjacent the pivot point end of the blade to the other end of the blade, and each blade having an arc-shaped tapered portion positioned at the pivot point end of the cutting edge of the blade and each portion being tapered toward the center of the film track in direction of movement of the film to engage a misaligned portion of the film web and urge it back into proper alignment as it travels through the severing station.

3. The apparatus of claim 2 wherein the knife blades have front sides and the cutting edge of the pivoted upper blade is tapered, the tapered portions being formed at a 45° angle relative to the front sides of the knife blades and the tapered portion of the upper blade being an arced extension of the taper of the cutting edge of the upper blade at the pivot point end of the upper blade.

4. The apparatus of claim 2 and a pair of curved shoes mounted over the film web proximate the knife means and positioned to prevent longitudinal curl of the film web as the web travels through the knife means.

5. The apparatus of claim 4 wherein the curved shoes are secured to a knife shield at the second end of the film track, the shoes being at the lower edge of the knife shield and shaped to curve away from the knife means toward the film track and then upwardly from the film track to provide a curved surface over edges of the film web to urge the film web downwardly and counteract the longitudinal curl of the film web as the film web enters the insertion station.

6. The apparatus of claim 4 and further comprising: a support having a pair of legs secured to the pivoted upper blade below the film track so that when the upper blade is in an open upstanding position, the film web is supported at its edges on the legs of the support and when the upper blade is in a downward closed severing position, the legs and the support are pivoted downwardly away from the film web, and each leg of the support being positioned under the film track and under one of the shoes to cooperate with the shoe to support and guide the film web through the severing station.

7. An apparatus for severing a segment of photographic film from a photographic film web, the apparatus comprising:

a substantially horizontal film track for guiding the film web along a path to a severing station;

film advance means for advancing the film web along the film track;

knife means at the severing station, the knife means having a pivoted upper blade and a stationary lower blade, one end of the pivoted upper blade being pivotally attached to one end of the stationary lower blade at a pivot point to form a scissors type knife, the blades cooperating to sever the segment from the film web, each blade in the knife means having a cutting edge extending from adjacent the pivot point end of the blade to the other end of the blade, a support mounted to the upper blade below the film track and having a pair of legs fixedly secured to said support so that when the upper blade is in an open upstanding position, the film web is supported from below only at its edges on the legs of the support and when the upper blade is in a closed downward severing position, the legs and the support are pivoted downwardly with the upper blade and away from the film web; and a pair of curved shoes mounted over the film web proximate the knife means and positioned only to contact the film web along its longitudinal edges to prevent longitudinal curl of the film web as the film web travels into the knife means, with each curved shoe being positioned over the film track and over one of the legs to cooperate with the leg to support and guide the film web through the severing station.

* * * * *